US006494744B1

(12) United States Patent
Lee

(10) Patent No.: US 6,494,744 B1
(45) Date of Patent: Dec. 17, 2002

(54) CONNECTOR ASSEMBLY

(75) Inventor: Fred Lee, Yungho (TW)

(73) Assignee: Wieson Electronic Co., Ltd., Taipei Hsien (TW)

( * ) Notice: Subject to any disclaimer, the term of this patent is extended or adjusted under 35 U.S.C. 154(b) by 0 days.

(21) Appl. No.: 09/876,923

(22) Filed: Jun. 11, 2001

(51) Int. Cl.[7] ..... H01R 13/648
(52) U.S. Cl. ..... 439/610; 439/607; 439/502
(58) Field of Search ..... 439/502, 607, 439/609, 610, 505

(56) References Cited

U.S. PATENT DOCUMENTS 4,941,845 A * 7/1990 Eppley et al. ..... 439/502
5,092,794 A * 3/1992 Kachlic ..... 439/607
5,829,991 A * 11/1998 Murphy et al. ..... 439/610
5,247,968 A1 * 6/2001 Wu ..... 439/607
6,287,148 B1 * 9/2001 Huang ..... 439/610
6,328,588 B1 * 12/2001 Tsai et al. ..... 439/610

* cited by examiner

*Primary Examiner*—Hien Vu
(74) *Attorney, Agent, or Firm*—Rosenberg, Klein & Lee

(57) ABSTRACT

A signal wire of a connector includes a housing, a connecting casing, a plug, a soft cable, and a connector. The front side of the plug is installed with two trenches. Terminals are installed in the trenches. The trenches can be inserted by a computer peripheral. The rear side of the plug is connected to the soft cable. The soft cable encloses a plurality of wires. The soft cable and the wires pass out of the round hole of the connecting casing. One end of the wire is secured to the terminal in the trench. Another end of the wire is connected to a connector. The connector can be connected to a circuit board of a computer. The soft cable is bendable so as to avoid that the plug is only inserted to one side of the circuit board. The position of the circuit board can be adjusted conveniently.

1 Claim, 6 Drawing Sheets

CONNECTOR ASSEMBLY

FIELD OF THE INVENTION

The present invention relates to a signal wire of a connector, and especially to connecting wire which is used to a circuit board of a computer or other related circuit board. Not only the assembly work is easy, but also the user may use it conveniently.

BACKGROUND OF THE INVENTION

Referring to FIGS. 1 and 2, a prior art connector is illustrated. The connector includes a plug 10. The plug 10 is firmly secured to a circuit board 14. The plug 10 has two connecting bodies 11. A rear side of the connecting body 11 is installed with a plate 111. The plate 111 is capable of being connected to a computer panel 112. The plate 111 and the computer panel 112 can be screwed together by two screws 113.

The front side of each connecting body 11 is formed with a slot 12. The slot 12 may be inserted by a plug (not shown) of a computer peripheral (such as a mouse, a modem, etc.). A plurality of terminals 13 are installed in the slot 12. Each terminal extends out of the plug 10. The extending terminal 13 can be inserted to a circuit board 14 so that the computer peripheral can work successfully.

However, since the plug 10 must be firmly secured to the circuit board 14 and is inserted to a computer peripheral so that the computer peripheral can operate successfully. The plug 10 has a preset volume, and therefore, the updating work of the circuit board 14 is difficult due to an insufficient space.

Moreover, the plug 10 must be firmly secured to the circuit board 14, and thus the plug 10 and slot 12 are only fixed to one side of the circuit board 14. However, currently, there are many computer peripherals. If the device is not compatible to the plug 10 at one side of the circuit board 14, a further adaptor is necessary, thereby, the cost burden of the user is increased.

Furthermore, since the plate 111 and computer panel 112 must be screwedly locked by screw 113. The screw opener are necessary to assembly the two. This is convenient since the opener is often lost or forget. Moreover, if the locking force of the screw is too large, the thread is easy to be damaged so that the screw 113 will rotate idly. The screw must be assembled again. Thus, the resource is wasted and the assembly cost is increased. However, these are inconvenient and necessary to be improved.

SUMMARY OF THE INVENTION

Accordingly, the primary object of the present invention is to provide a signal wire of a connector, wherein the installing position and inserting direction of the plug can be adjusted effectively so as to avoid that the computer is difficult in assembly and updating due to an insufficient internal space. Various computer peripherals can be used with the present invention. No extra adaptor (not shown) is necessary. The cost is saved and the assembly work is convenient.

To achieve the objects, the present invention provides a signal wire of a connector including a housing, a connecting casing, a plug, a soft cable, and a connector. The front side of the plug is installed with two trenches. Terminals are installed in the trenches. The trenches can be inserted by a computer peripheral. The rear side of the plug is connected to the soft cable. The soft cable encloses a plurality of wires. The soft cable and the wires pass out of the round hole of the connecting casing. One end of the wire is firmly secured to the terminal in the trench. Another end of the wire is connected to a connector. The connector can be connected to a circuit board of a computer. The soft cable is bendable so as to avoid that the plug is only inserted to one side of the circuit board. The position of the circuit board can be adjusted conveniently. The assembly work is easy.

The various objects and advantages of the present invention will be more readily understood from the following detailed description when read in conjunction with the appended drawing.

DETAILED DESCRIPTION OF THE PREFERRED EMBODIMENTS

Figure 1:
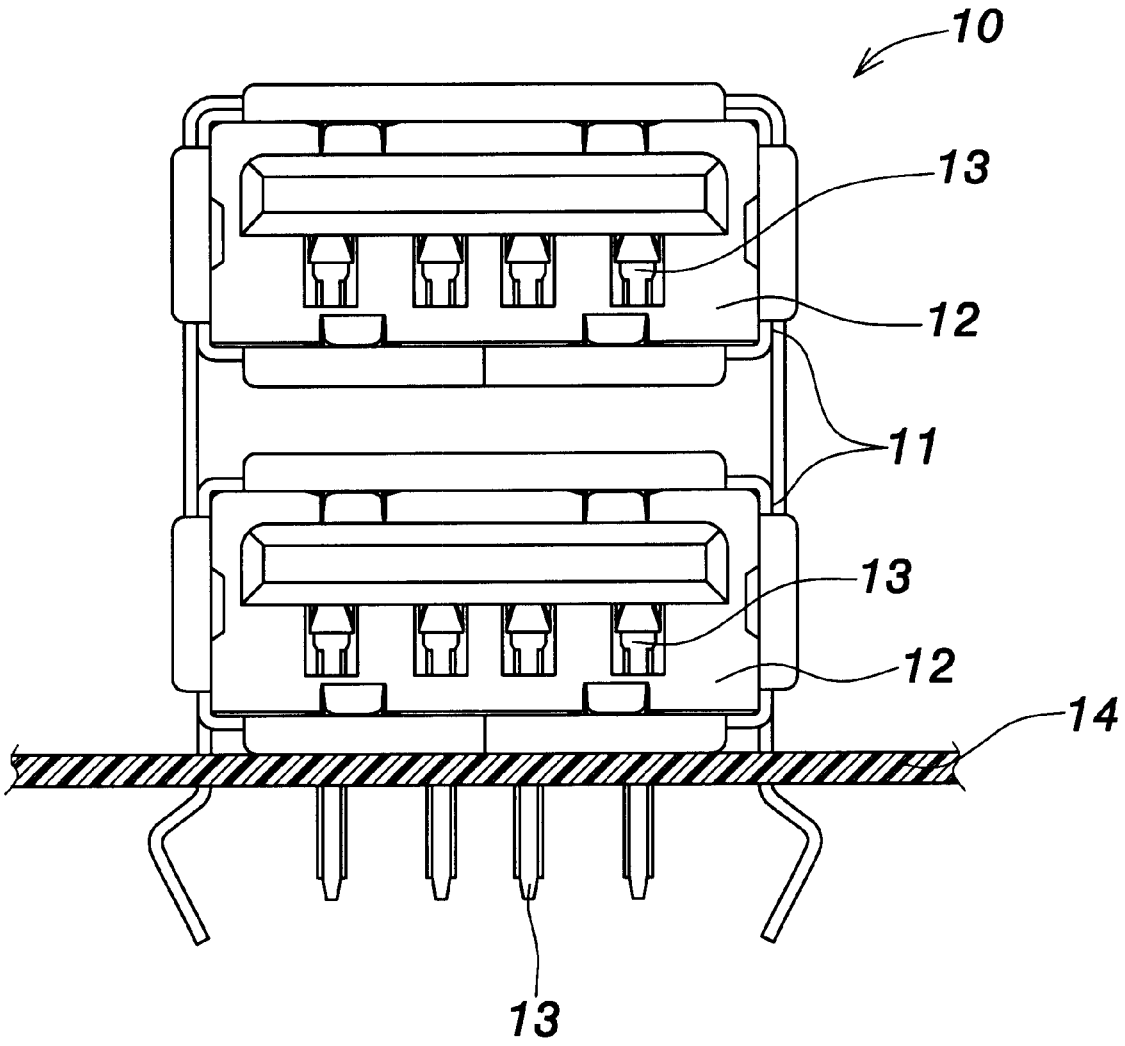
FIG. 1 PRIOR ART
FIG. 1 is a front view of a prior art computer connecting structure.
Figure 2:
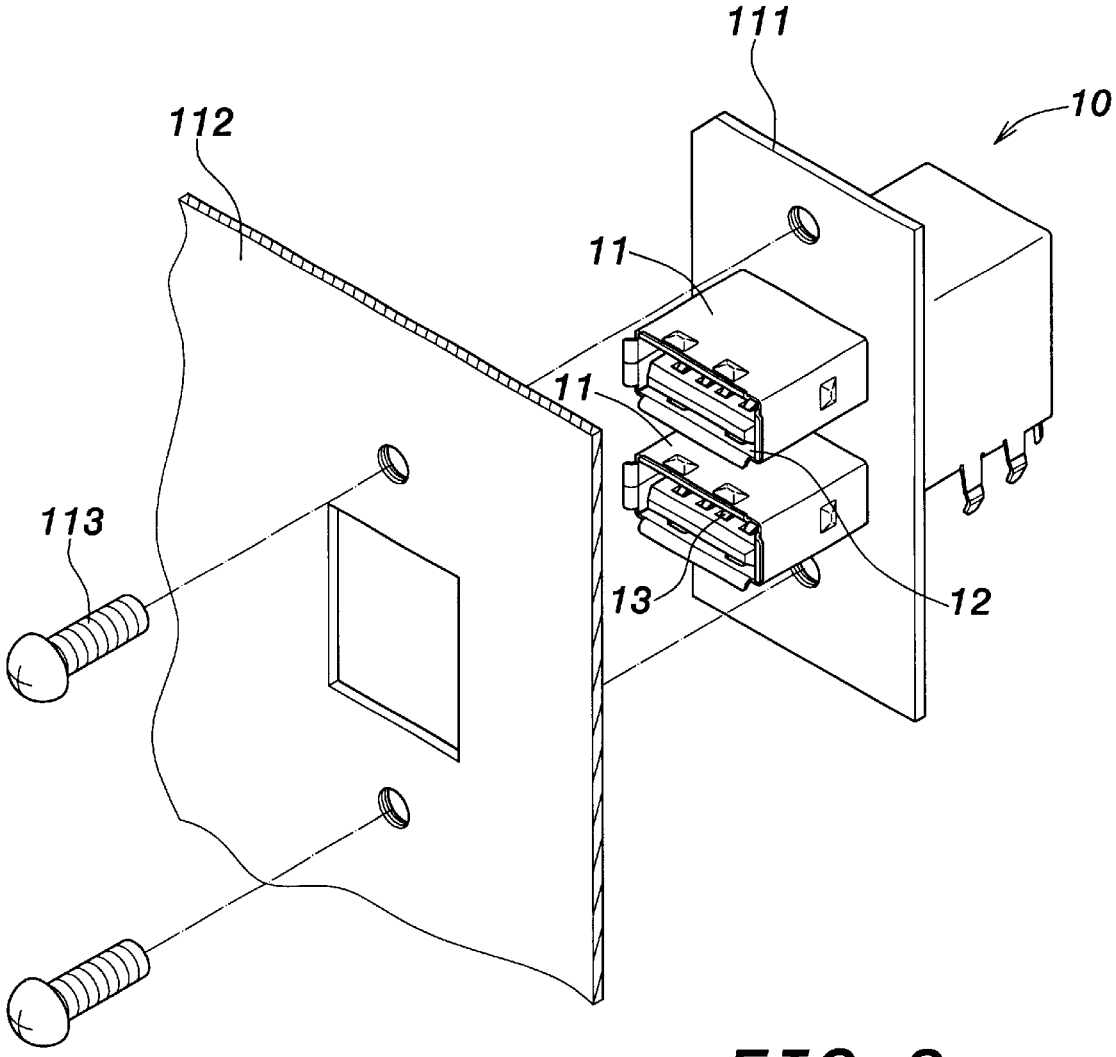
FIG. 2 PRIOR ART
FIG. 2 is an exploded perspective view of a prior art computer connecting structure.
Figure 3:
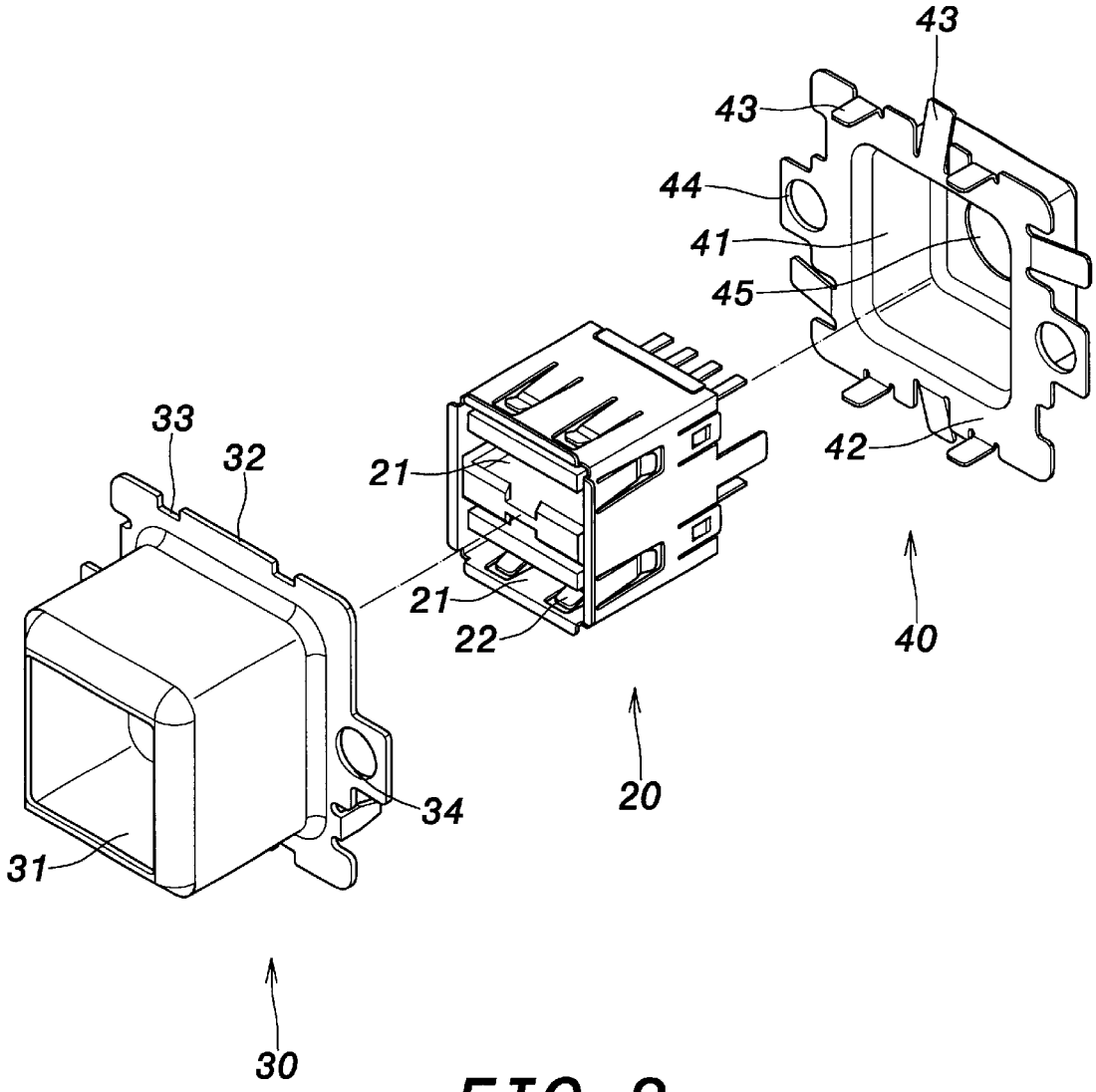
FIG. 3 is an exploded perspective view of the housing, plug, and connecting casing of the present invention.

To more understand the present invention by those skilled in the art, in the following, the details will be described with the appended drawings. However, all these descriptions are used to make one fully understand the present invention, while not to used to confine the scope of the present invention defined in the appended claims.

Referring to FIGS. 3 to 6, the signal wire of a connector of the present invention is illustrated, which is especially to be connected to a circuit board of a computer or circuit boards of other devices. The signal wire of a connector includes a housing 30, a connecting casing 40, a plug 20, a soft cable 50, and a connector 60.

The plug 20 is enclosed in the housing 30 and the connecting casing 40. The housing 30 and the connecting casing 40 are made of for example metal and are formed integrally. The housing 30 and connecting casing 40 made of metal can be used to prevent electromagnetic interference (EMI). A front side of the housing 30 is formed with an opening 31. The rear side of housing 30 is formed with a flange 32. The flange 32 is installed with a plurality of notches 33 and slots 34. The opening 31 can be engaged with the plug 20.

The front side of the connecting casing 40 is installed with a groove 41 which can be engaged with the plug 20 conveniently. A front side of the connecting casing 40 is formed with a connecting face 42 matching to the rear flange 32 of the housing 30. The connecting surface 42 is installed with a power supply strips 43 and slots 44. The strips 43 is bendable to buckle the notch 33 of the flange 32. The slots 34 and 44 can be screwed to the housing 30 and the connecting casing 40 by screws (not shown) (referring to FIG. 4). The housing 30 is fixed to a computer 70 (referring to FIG. 6). The groove 41 of the connecting casing 40 is installed with a round hole 34 which can be inserted by the soft cable 50 (referring to FIG. 4).

The front side of the plug 20 is installed with two trenches 21. A plurality of terminals 22 are installed in the trenches

21. The trenches 21 can be inserted by a computer peripheral (such as a mouse, a modem, etc.) (not shown). The rear side of the plug 20 is connected to the soft cable 50 (referring to FIG. 4). The soft cable 50 encloses a plurality of wires 51. The soft cable 50 and the wires 51 pass out of the round hole 45 of the connecting casing 40. One end of the wire 51 is firmly secured to the terminal 22 in the trench 21. Another end of the wire 51 is connected to a connector 60. The connector 60 can be connected to a circuit board 50 of a computer 70 (referring to FIG. 6) or other related circuit board.

Figure 4:
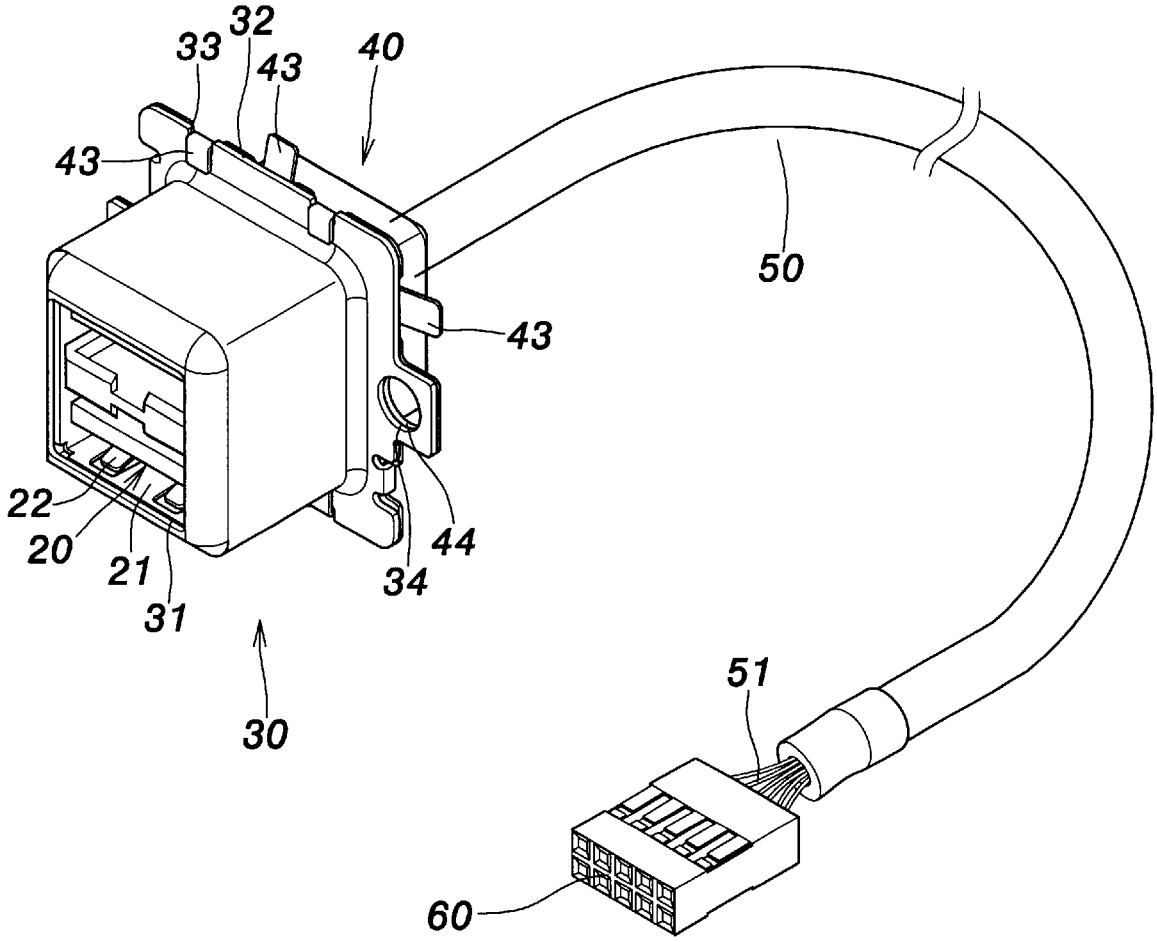
FIG. 4 is an exploded perspective view of the present invention.
Figure 5:
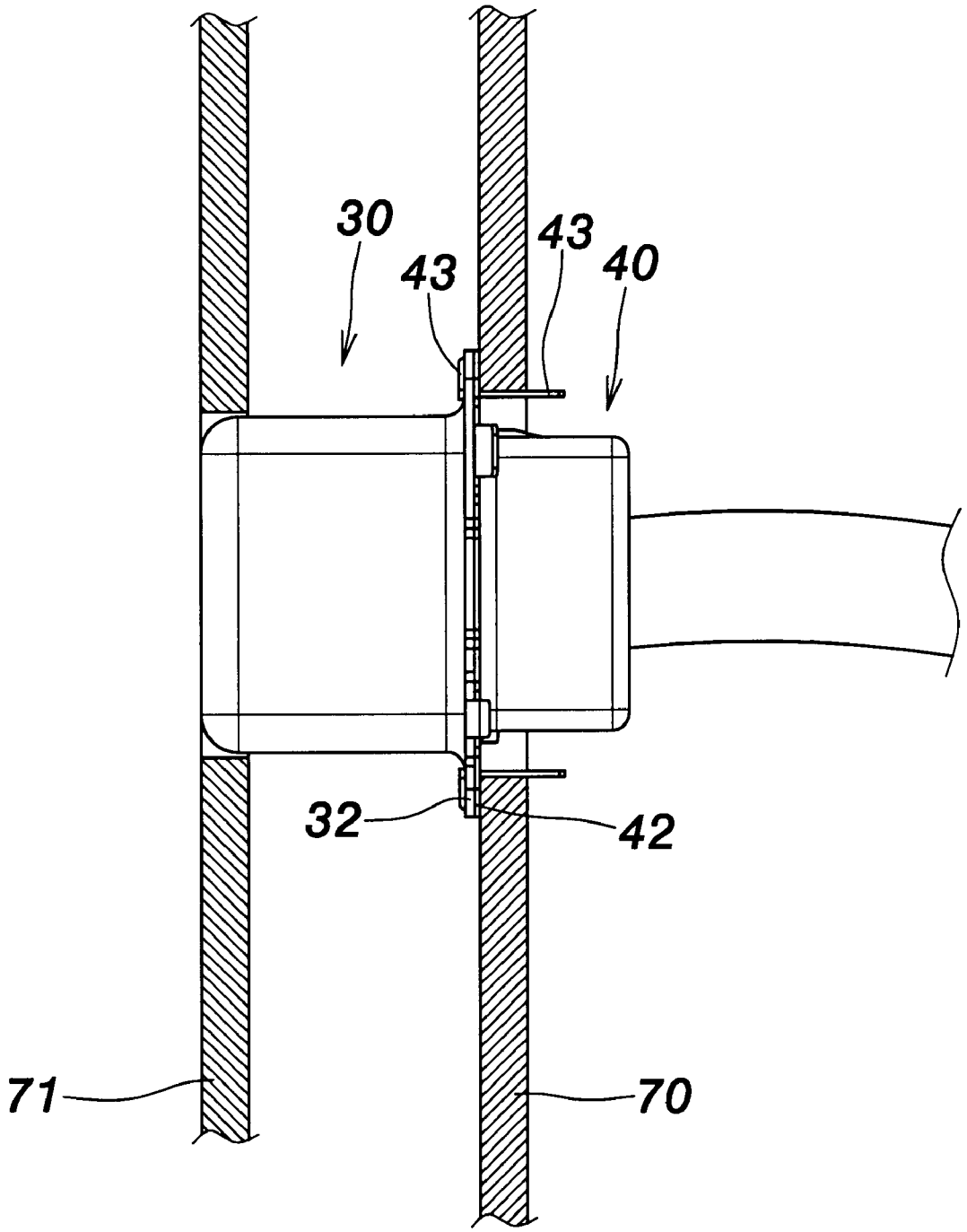
FIG. 5 is a cross sectional view of the present invention.
Figure 6:
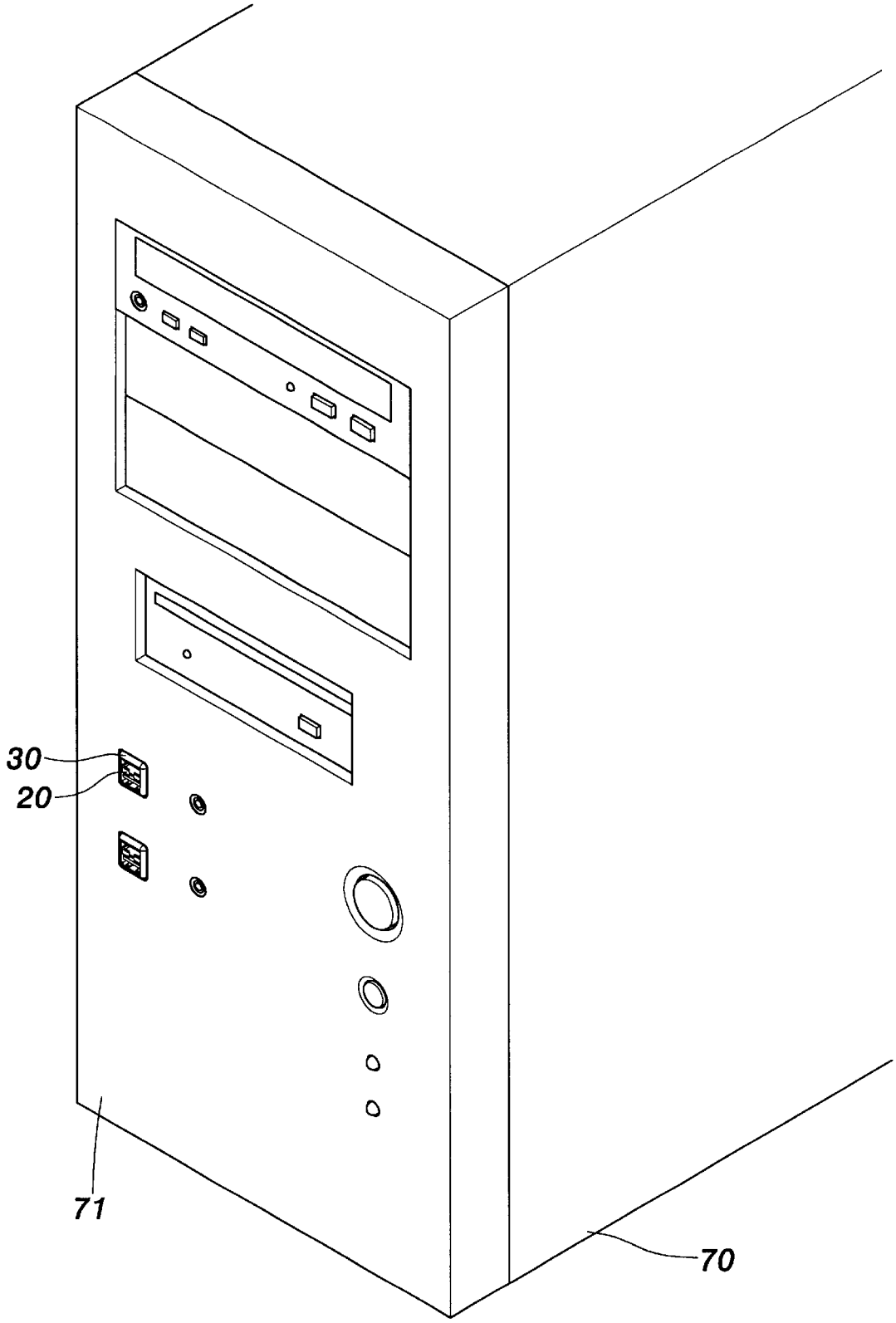
FIG. 6 shows one application of the present invention.

Referring to FIGS. 4, 5 and 6, since the soft cable 50 and the wire 51 are bendable, the user is only necessary to match the connector 60 with the orientation and inserting point of the circuit board, then the connector 60 may be inserted into the circuit board successfully to avoid that the plug only fixedly inserted into one side of a circuit board. Therefore, the computer 70 is difficult in assembly and updating due to insufficient internal space.

Since in the present invention, the installing position and inserting direction of the plug 20 can be adjusted effectively so as to avoid that the computer 70 is difficult in assembly and updating due to insufficient internal space. Various computer peripherals can be used with the present invention, no extra adaptor (not shown) is necessary. The cost is saved and the assembly work is convenient.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A connector assembly for mounting on a computer's casing, comprising:

a housing formed of metal and having an opening formed therein, the housing having a flange circumscribing a rear end thereof, the flange having a plurality of notches formed therein;

a connecting casing formed of metal and connected to the housing, the connecting casing having a recess formed therein and a connecting face formed on one end of the connecting casing, the connecting face being disposed in juxtaposition with the flange of the housing and having a plurality of strip members formed thereon, a first portion of the plurality of strip members being respectively bent over the flange of the housing through the plurality of notches therein, a second portion of the plurality of strip members being bent toward a rear end of the connecting casing for engaging an edge portion of an opening in the computer's casing;

a plug enclosed in the opening of the housing and the recess of the connecting casing, the plug having a pair of slots formed therein for respectively receiving a pair of corresponding mating connectors, the plug having a plurality of terminals installed in each of the slots;

a soft cable having a first end connected to the plug, the soft cable enclosing a plurality of connecting wires respectively fixedly connected to the terminals within the slots at the first end of the soft cable; and a connector connected to the plurality of connecting wires at a second end of the soft cable.

* * * * *